United States Patent [19]

Rule

[11] Patent Number: 4,801,007

[45] Date of Patent: Jan. 31, 1989

[54] TEAT UNIT

[75] Inventor: Arthur W. T. Rule, Westbourne, Near Emsworth, England

[73] Assignee: John Wyeth & Brother, Limited, Maidenhead, England

[21] Appl. No.: 91,301

[22] Filed: Aug. 27, 1987

Related U.S. Application Data

[63] Continuation of Ser. No. 824,022, Jan. 30, 1986, abandoned.

[30] Foreign Application Priority Data

Feb. 7, 1985 [GB] United Kingdom ..... 8503140

[51] Int. Cl.[4] ..... B65D 83/00

[52] U.S. Cl. ..... 206/217; 215/11.3; 222/81; 229/103.1

[58] Field of Search ..... 206/217, 218, 527; 215/11.1, 11.3, 11.4, 11.5, 100 R; 222/81, 490; 229/103.1

[56] References Cited

U.S. PATENT DOCUMENTS

| | | | |
|---|---|---|---|
| 2,508,481 | 5/1950 | Allen | 215/11 E |
| 2,876,113 | 3/1959 | Barton | 215/11 E |
| 3,146,904 | 9/1964 | Hansen et al. | 215/11 E |
| 3,189,171 | 6/1965 | Miller | 229/75 |
| 3,214,102 | 10/1965 | Meyer | 222/490 |
| 3,255,923 | 6/1966 | Soto | 215/11 E |
| 3,266,910 | 8/1966 | Barnby | 215/11.1 |
| 3,411,648 | 11/1968 | Tichy | 215/11 D |
| 3,747,791 | 7/1973 | Fouser | 215/11 R |
| 3,874,554 | 4/1975 | Chang | 206/217 |
| 3,991,912 | 11/1976 | Soto | 215/11 E |
| 4,301,934 | 11/1981 | Forestal | 215/11 D |
| 4,558,792 | 12/1985 | Cabernoch et al. | 215/11 R |

FOREIGN PATENT DOCUMENTS

| | | | |
|---|---|---|---|
| 0167842 | 3/1951 | Austria | 222/81 |
| 0050459 | 4/1982 | European Pat. Off. . | |
| 1482682 | 7/1973 | Fed. Rep. of Germany | 222/81 |
| 2650093 | 5/1978 | Fed. Rep. of Germany | 222/81 |
| 0241813 | 10/1925 | United Kingdom . | |
| 0960123 | 6/1964 | United Kingdom . | |
| 1323928 | 7/1973 | United Kingdom | 215/11 C |
| 1555267 | 11/1979 | United Kingdom . | |
| 2116152 | 9/1983 | United Kingdom . | |

*Primary Examiner*—Jimmy G. Foster
*Attorney, Agent, or Firm*—Arthur G. Seifert

[57] ABSTRACT

A teat unit for insertion into a liquid container formed of a plastics/paper laminate comprises a tubular teat mounting having one end adapted for insertion through the liquid container and the other end adapted to receive a teat. Various methods of securing and sealing the unit to the container are disclosed.

15 Claims, 3 Drawing Sheets

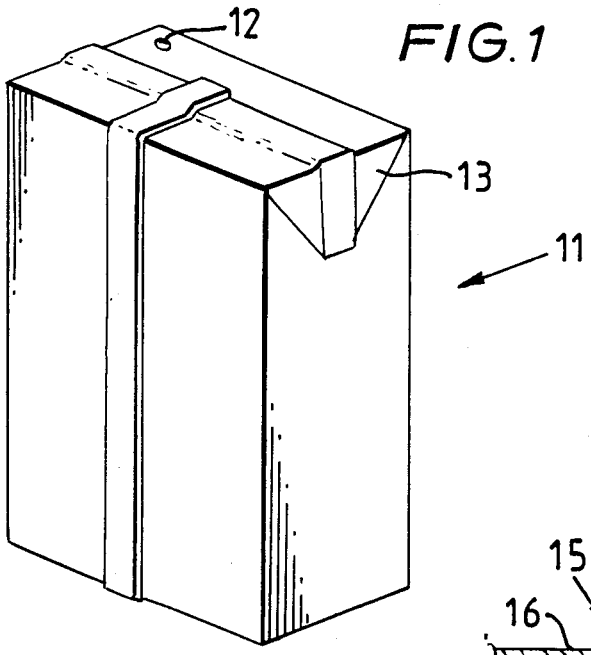
FIG. 1
FIG. 2
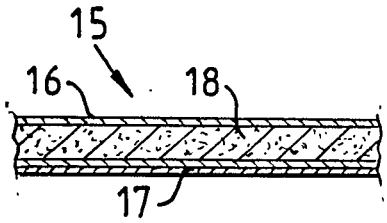
FIG. 3
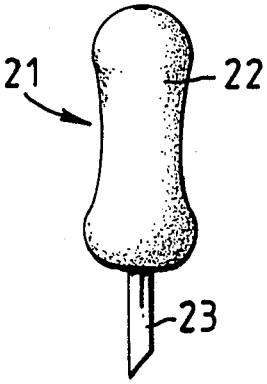
FIG. 4
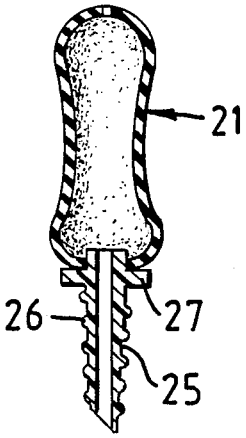
FIG. 5
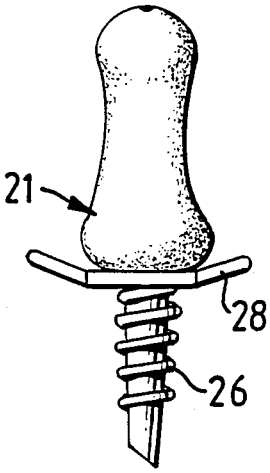

TEAT UNIT

This application is a continuation of application Ser. No. 824,022, filed Jan. 30, 1986 now abandoned.

This invention relates to teats and particularly to teats for use with sealed containers of liquid.

Liquids for feeding to babies may be supplied in sealed containers. In particular sterile ready to feed milks may be supplied in sealed bottles to which a teat may be attached after the bottle cap has been removed. Furthermore, a sterile teat and locking ring may also be supplied in a sealed package so that, prior to feeding, there is no question of contamination of either the milk or teat. The baby is consequently protected from infection and supplied with a product of substantially unvarying quality. The bottle and teat are intended for disposal after use.

Glass bottles have been used hitherto for packing sterile milks. It is also known to provide such bottles with an attached teat, the teat is maintained in a sterile condition by a removable outer cover. A membrane separates the milk from the teat so that 'wet' and 'dry' sterile chambers are provided during transit; means are provided to rupture the membrane immediately prior to feeding. The bottle and teat assembly is intended to be disposable. Whilst glass bottles have proved satisfactory they are heavy, bulky, have a low packing density and are becoming increasingly expensive when compared with the cost of the contents. Glass bottles are also susceptible to transit damage and must be packed securely, this further increases the cost to the consumer.

Liquids, especially ready to drink liquids, are nowadays frequently supplied in parallelepipedic boxes formed from a plastics/paper laminate. Such boxes are light, easily disposable, having a high packing density and are sufficiently flexible to withstand normal transit shocks without special packing. Laminate boxes can also be much cheaper than glass bottles provided that the quantities are sufficient.

Although ready to drink liquids suitable for babies could be supplied in such laminate boxes they would have to be dispensed into conventional feeding bottles. This would be awkward, probably messy and the risk of infection by contamination is increased.

According to the invention there is provided a teat mounting comprising a tubular body adapted at one end to be inserted through the wall of a liquid container and adapted at the other end to receive a teat.

Such a mounting provides means for feeding a baby from a laminate container of liquid without the necessity of first dispensing the liquid into a conventional feeding bottle. The advantages of laminate containers are thus available for baby drinks and liquid foods with a much reduced risk of contamination and resulting infection. Preferably a sterile mounting is provided in a hermetically sealed package although alternatively the mounting may be sterilized by any convenient means prior to use.

In one embodiment of the invention an interruption is provided on the mounting to limit insertion through the wall of the container; the interruption may be a continuous generally circular flange.

Sealing means may be provided to seal the mounting against the container wall. Any suitable sealing means may be employed for example a resiliently compressible annular seal disposed about the mounting. In an alternative construction adhesive may be provided on the seal or on the mounting itself to provide a strong leakproof join. Such sealing means is in addition to the seal formed by one or more polythene layers of a laminate of the type herein described.

Retaining means may be provided on the mounting or on the container to hold the mounting and container together. The retaining means may comprise one or more screw threads; the screw thread or threads may be discontinuous and may vary in pitch, depth and form to suit the intended use. The retaining means may alternatively 'snap' into the container wall by, for example, having a shoulder with a tapered lead over which the container wall may be stretched; such retaining means may include screw threads also.

One end of the mounting may be adapted to pierce the container wall. The mounting may, for example, be sharply pointed to pierce the wall and such a construction is especially useful where the container does not have a defined entry port.

A teat may be supplied separately for attachment to the mounting or preferably is supplied ready attached. Any known means of attachment is suitable, for example by moulding, by adhesive or by the natural elasticity of the teat material. In the last mentioned case the teat may be snapped or stretched into a groove provide on one end of the mounting. Preferably a sterile teat and mounting unit is provided in an hermetically sealed package.

A container of ready to drink liquid may be provided with a sterile teat and mounting unit attached thereto. Such an arrangement is especially useful for mothers and babies when travelling, where convenience and cleanliness are essential and for new born babies where individual low cost supplies of ready to feed milk of a consistent quality are in demand. Such containers may, for example, contain a ready to feed milk preparation, a fruit juice or a dextrose preparation.

The invention also provides a method of feeding a baby comprising the steps of providing a container of ready to drink liquid; inserting a tubular body through the wall thereof; providing a teat on the outer end of said body; and feeding the baby by the passage of liquid from the container through the body to said teat.

Other features of the invention will be apparent from the following description of several embodiments shown by way of example only with reference to the accompanying illustrative drawings, in which:

FIG. 1 is an isometric view of a typical liquid container formed from a paper/plastics laminate;

FIG. 2 is a section through a typical paper/plastics laminate;

FIG. 3 is a side elevation of the invention in a simple form;

FIG. 4 is an axial section through a second embodiment of the invention;

FIG. 5 is a side elevation through a third embodiment of the invention somewhat similar to the embodiment of FIG. 4;

Figure 6:
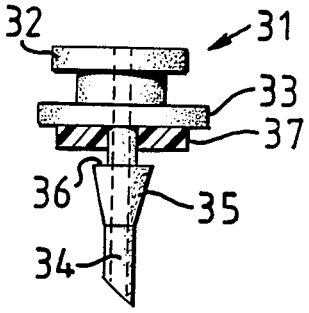
FIG. 6 is a partial axial section through a teat mounting and seal assembly.
Figure 7:
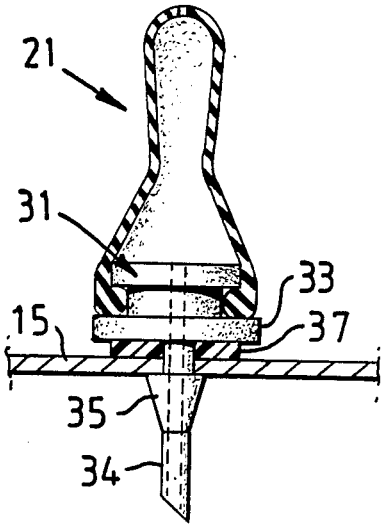
Figure 6A:
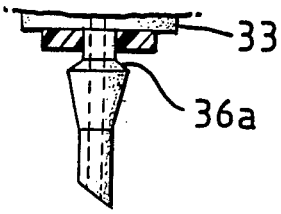
Figure 8:
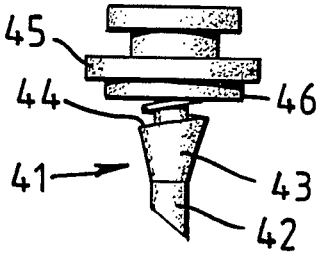
Figure 9:
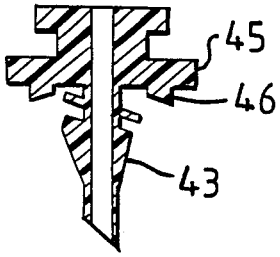
Figure 10:
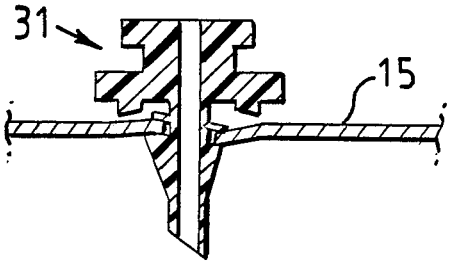
Figure 11:
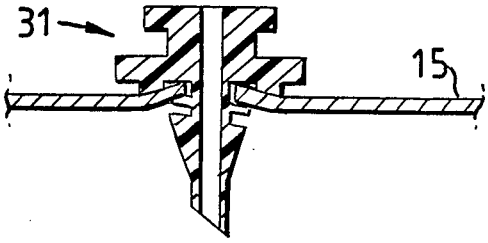
Figure 12:
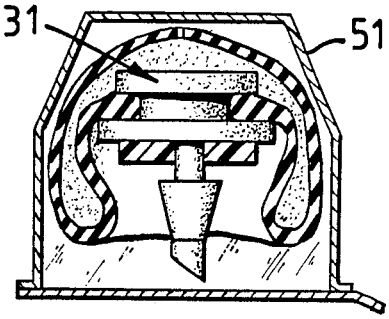
Figure 13:
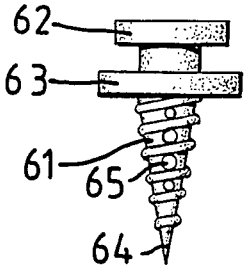

FIG. 6*a* shows the assembly of FIG. 6 with a modified teat mounting;

FIG. 7 is a part axial section through the assembly of FIG. 6 inserted into a container and having a teat affixed thereto;

FIG. 8 is a side elevation of an alternative teat mounting;

FIG. 9 is an axial section through a teat mounting according to FIG. 8;

FIG. 10 corresponds to FIG. 9 and shows the mounting engaged in the wall of a liquid container;

FIG. 11 corresponds to FIGS. 9 and 10 and shows the mounting tightened in the container wall;

FIG. 12 shows a sterile teat, teat mounting and seal assembly packaged as an hermetically sealed unit; and FIG. 13 is a side elevation of further alternative teat mounting.

With reference to FIG. 1 there is shown a liquid container 11 formed from a paper/plastics laminate. The container includes an entry port 12 of reduced thickness laminate through which a tube may be pushed to shear the remaining laminate layers; liquid may then be sucked through the tube.

Alternatively an end flap 13 may be lifted and torn or cut to provide a pouring spout for the container; dotted lines are often provided on the flap to indicate the best place to cut.

A section through a typical laminate 15 is shown in FIG. 2. A thin plastics layer 16, 17 is provided on either side of a relatively thick layer of carrier material 18. The plastics material may be polythene and the carrier material may be paper, card or some other fibrous material. The plastics material is of a type which can be easily heat sealed as the container is shaped. The laminate may include other layers, for example, a layer of aluminium foil, to provide an oxygen barrier and to reduce the transmission of light; the shelf life of the product is thereby prolonged.

Such liquid containers are light, flexible, have a good packing density and are resistent to transit damage. They are hermetically sealed to maintain the contents in a sterile condition and are suitable for ready to drink milks for babies. Containers of this type are sold, for example, under the names Tetrabrik (trade mark) and Combibloc (trade mark).

A simple embodiment of the invention is shown in FIG. 3. A teat unit 21 comprises a teat 22 attached by any convenient means to a tubular mounting 23. The mounting includes an extension spike for insertion through the port 12 so that liquid can pass to the teat. On insertion of the spike the polythene layer(s) will be partly sheared and partly stretched to grip the spike and prevent leakage when the container is held in the feeding position. Air is admitted to the container in the usual way be removing the teat from the babies mouth, alternatively any one of a number of known solutions can be provided to bleed air into the container to balance the volume of liquid withdrawn.

A sterile teat and mounting can be provided in an hermetically sealed package, as will be further described hereinafter so that prior to feeding both teat and liquid remain in a sterile condition.

After feeding has finished the container and teat unit can be thrown away.

An alternative teat unit is shown in FIG. 4. The mounting has a tapered threaded spike 25 (also shown in FIG. 5). The spike is pushed through the port 12 of the container and the wall of the port may stretch over several circuits of the thread 26 until the teat unit is almost fully inserted. The teat unit may then be turned to tighten the unit into the container until a flange 27 engages the container wall. The threaded spike ensures that the teat unit is positively engaged with the container; the abutment of the flange 27 with the outer surface of the container providing an additional seal against leakage of liquid.

The embodiment of FIG. 5 includes ears 28 for screwing the teat unit into the container, the ears assist in preventing contamination of the teat itself from the assemblers fingers.

The embodiments of FIGS. 4 and 5 are more suitable for older babies who can hold the container and feed themselves. The embodiment of FIG. 3 is suitable for small babies who are not able to pull the teat unit out of the container.

FIGS. 6 and 7 show an alternative push-in teat mounting 31 including a fluid seal 37. The mounting comprises a tubular body having spaced flanges 32, 33 at its outer end intended to locate a teat stretched over the outermost flange 32 (as shown in FIG. 7). A cylindrical spike 34 includes a regular tapered flange 35 increasing in diameter from the spike end to terminate in a shoulder 36 facing the flange 33. Between the shoulder 36 and flange 33 is an annular seal 37; the axial distance between shoulder and flange is somewhat less than the combined thickness of the seal 37 and the wall of the container 11.

In use the mounting, with or without teat attached, is pushed into the port 12, the port wall is stretched but not torn by the tapered flange 35 and the seal 37 compresses against the container wall to allow the port wall to snap into the gap between shoulder 36 and seal 37. The seal, which can be made of any suitable compressible resilient elastic material, expands to tightly seal the mounting against container as shown in FIG. 7.

In the alternative embodiment shown in FIG. 6*a*, the shoulder 36*a* is tapered toward the flange 33 to more tightly grip the container wall.

The mounting of FIGS. 6 and 7 provides a secure leak resistant teat attachment without screw-threading. This arrangement obviates the problem of the assembly not knowing which way to turn a screw-threaded mounting to tighten the unit against the container and not knowing the optimum tightening torque.

The embodiment shown in FIGS. 8 to 11 has a push and twist operation. The mounting 41 is shown with a double flanged outer end corresponding to FIG. 6 and for receiving a stretch-on teat. The spike 42 of the mounting includes a tapered flange 43 which terminates in a shoulder 44. The spike is threaded from the shoulder to the inner face of the flange 45; the thread is preferably a buttress thread as depicted and the shoulder 44 forms a lower buttress wall of the thread.

A co-axial annular extension 46 is provided on the flange 45 extending towards the tapered flange 43 and surrounding the upper portion of the thread. The extension 46 tapers from its inner to its outer diameter so that the height of the extension is greatest at the outer diameter.

In use the mounting 41 is pushed into the port 12 until the port wall snaps over the tapered flange 43 into the lower portion of the buttress thread; this position is shown in FIG. 10. The mounting is then turned until the container wall is squeezed firmly between the upper part of the thread and the annular extension 46 as shown in FIG. 11.

Such a construction provides a firm leak resistant connection between the mounting and the container without the use of separate sealing rings.

FIG. 12 shows a sterile teat and mounting unit enclosed in an hermetically sealed container 51. The teat is folded around the body of the mounting for packaging and is easily pulled into position on opening the container and removing the unit. The teat may be arranged to spring automatically into position by careful design of the mounting and teat. The container is shown enclosing a teat unit already described with reference to FIGS. 6 and 7 but any of the teat units described herein could be similarly packaged. The container may be sterilized by irradiation after packing.

FIG. 13 shows yet another alternative teat mounting comprising a hollow body 61 having a double flange 62, 63 to receive a stretch on teat and a sharply pointed threaded spike 64. The body has an opening extending from the upper flange into the spike; apertures 65 in the base of the thread communicate with the opening to provide a liquid supply path. This teat mounting is intended for use with liquid packs for which no port is provided. The user makes a hole with the sharply pointed end of the spike 64 and screws the spike into the container wall until the outer face of the container is in tight abutment with the underside of flange 63. Such a mounting is useful where it is intended to use an alternative type of liquid container or where a port provided on the container is not in a suitable place, for example the port may be too close to the container edge for an adequate seal to be maintained under all conditions of use. The mounting could of course be used in a container port if desired.

As an alternative the apertures 65 could be replaced by one or more axial slots between discontinuous portions of the screw thread. Other solutions are possible provided always that the spike has adequate mechanical strength to pierce a container wall.

The present invention has been described with reference to several example embodiments only; many modifications or alternatives are possible which would fall within the scope of the invention. For example, the teat could alternatively be attached to the mounting by adhesive or by crimping; the teat and mounting could be moulded as a single unit. The mounting is preferably of plastic but could be of any suitable material compatible with strength and hygiene requirements. The mounting may be for example, of polythene, polystyrene or cellulose acetate.

The thread shown on certain embodiments may be a regular conventional thread form or may vary in pitch or depth to suit the particular requirements of use. The thread profile may be rounded to ease insertion of the mounting, may be a buttress thread to provide positive engagement or may be a combination of both. Several thread forms may run together to provide a 'quick-start' so that the minimum rotation of the unit will provide positive sealing engagement between the mounting and container. The profile and pitch of the thread form may vary along its length.

The invention has been described with particular reference to fluid containers made from a paper/plastic laminate. The containers would in the ordinary case hold quantities sufficient for a single feed for a baby but might be of the order of 100 ml to one litre in capacity.

The teat units disclosed herein are also suitable for use with other types of paper and plastic containers and might also be used with, for example, glass bottles sealed by a piercable membrane.

Although the applicants intend their invention for use with laminate containers of ready to feed milk formulations, the teat units can be used with any suitable packed liquid drink.

I claim:

1. A teat unit comprising (a) a one piece teat mounting comprising a narrow tube for sucking liquid therethrough, said tube having (1) a short piercing end adapted to be inserted through a semi-rigid container wall, (2) a teat mounting end for securely receiving a retaining and sealing means on a teat, (3) a flange between said two ends and about the circumference of said tube for limiting insertion of the tube, (4) adhesive sealing means on the face of said flange adjacent the piercing end for sealing said flange against the outer side of said container and (5) retaining means between said flange and said piercing end engageable with said container wall for urging said sealing means into sealing engagement with said wall; and (b) a teat adapted to said teat mounting end.

2. A teat unit according to claim 1, wherein said retaining means comprises a shoulder having a tapered lead over which the container wall may stretch on insertion.

3. A teat unit according to claim 2, wherein the shoulder is additionally tapered towards the limiting flange.

4. A teat unit according to claim 1, wherein the axial distance between the flange and the retaining means is slightly less than the thickness of the wall of the container.

5. A one-piece teat mounting comprising a narrow tube for sucking liquid therethrough, said tube having (1) a short piercing end adapted to be inserted through the wall of a semi-rigid container wall, (2) a teat mounting end for securely receiving a retaining and sealing means on a teat, (3) a flange between said two ends and about the circumference of said tube for limiting insertion of the tube, and (4) retaining means and sealing means which comprise, in combination, (a) adjacent the piercing end a tapered flange which terminates in a shoulder where up to two screw thread turns begin and continue to the face of the limiting flange and (b) a co-axial annular extension of the limiting flange which surrounds the circumference of said screw thread.

6. A teat mounting according to claim 5 wherein the screw thread is a buttress thread and the shoulder of the tapered flange forms a lower buttress wall of the thread.

7. A teat mounting according to claim 5 wherein the co-axial annular extension on the piercing end side of the limiting flange is tapered towards the center of the tube.

8. A teat unit comprising (a) a one piece teat mounting comprising a narrow tube for sucking liquid therethrough, said tube having (1) a short piercing end adapted to be inserted through a semi-rigid container wall, (2) a teat mounting end for securely receiving a retaining and sealing means on a teat, (3) a flange between said two ends and about the circumference of said tube for limiting insertion of the tube, (4) sealing means comprising a co-axial annular extension on the face of said flange adjacent to the piercing end for sealing said flange against the outer side of said container and (5) retaining means between said flange and said piercing end engageable with said container wall for urging said sealing means into sealing engagement with said wall; and (b) a teat adapted to said teat mounting end.

9. A teat unit according to claim 8 wherein the co-axial annular extension is tapered towards the center of the tube.

10. A teat unit according to claim 8 wherein said retaining means comprises a shoulder having a tapered lead over which the container wall may stretch on insertion.

11. A teat unit according to claim 10 wherein the shoulder is additionally tapered towards the limiting flange.

12. A teat unit according to claim 8 wherein the axial distance between the face of the limiting flange and the closest portion of the retaining means is slightly less than the thickness of the container wall.

13. A one-piece teat mounting comprising a narrow tube for sucking liquid therethrough, said tube having (1) a short piercing end adapted to be inserted through the wall of a semi-rigid container wall, (2) a teat mounting end for securely receiving a retaining and sealing means on a teat, (3) a flange between said two ends and about the circumference of said tube for limiting insertion of the tube, and (4) retaining means and sealing means which comprise, in combination, (a) adjacent the piercing end a tapered flange which terminates in a shoulder and (b) a co-axial annular extension of the limiting flange which surrounds the circumference of said shoulder.

14. A one-piece teat mounting according to claim 13 wherein the coaxial annular extension is tapered towards the center of the tube.

15. A one-piece teat mounting according to claim 13 wherein the shoulder is additionally tapered towards the limiting flange.

* * * * *